United States Patent [19]

Schroeder

[11] 4,166,558

[45] Sep. 4, 1979

[54] INFANT CARRIER

[76] Inventor: Warren E. Schroeder, 70 Linwood Ave., Emerson, N.J. 07630

[21] Appl. No.: 923,147

[22] Filed: Jul. 10, 1978

[51] Int. Cl.[2] ..... A47D 13/02

[52] U.S. Cl. ..... 224/158; 224/49; 297/188; 224/159

[58] Field of Search ..... 224/6, 5 Q, 5 BC, 5 MA, 224/8 R, 25 A, 49, 58; 297/188, 17

[56] References Cited

U.S. PATENT DOCUMENTS

| | | | |
|---|---|---|---|
| 3,197,100 | 7/1965 | Thompson | 224/6 |
| 3,331,540 | 7/1967 | Higuchi | 224/6 |

*Primary Examiner*—Robert J. Spar
*Assistant Examiner*—Kenneth Noland
*Attorney, Agent, or Firm*—Samuelson & Jacob

[57] ABSTRACT

A multiple position infant carrier in which a main member of flexible material is supported at the front of a person carrying the infant by a main strap extending over one shoulder and around the back of the person, while a supplementary head strap extends over the other shoulder and around the back of the person to pass through loops on the main member, the arrangement of the loops and the head strap establishing a seat portion and back and head support portions for the infant.

9 Claims, 6 Drawing Figures

INFANT CARRIER

The present invention relates generally to infant carriers and pertains, more specifically, to an infant carrier in which the infant is supported in a selected position at the front of the person carrying the infant.

Infant carriers have been used in one form or another practically since the dawn of civilization. Improvements in these devices have been developed through the ages and further developments are still taking place. Thus far, however, most of the designs developed for carrying infants fail to take into full account the anatomy and the psychology of newborn infants, as well as of the person carrying an infant.

It has been found desirable to support infants, and especially newborn infants, in a manner which simulates the way in which the child would be held in the arms of its mother. More specifically, the infant will be most comfortable and feel most secure in a position extending diagonally along the chest and abdomen of the person carrying the infant, with the child's head in proximity to the breast of the person and with adequate support for the child's head and along the length of the child's spine. It is also desirable that the infant's face, and especially the nose and mouth area, be visible at all times and that the infant be able to view not only the person who carries the infant but to observe the surrounding world. In this way, the learning and growing experience is enhanced at a very early age. Such advantages are not available in back pack, front pack, and like devices where the carried infant usually straddles the torso of the person carrying the infant.

As the newborn infant approaches the age where sufficient strength is developed in the neck and the back to maintain a self-supporting position, it is advantageous to have a carrier device available which will accommodate an infant in a sitting position. Currently available infant carriers are rather limited in their ability to be adapted to the needs of a growing infant.

It is an object of the present invention to provide an infant carrier in which the infant is supported in a selected position at the front of the person carrying the infant, in a manner simulating the way in which the infant would be held in the arms of the person holding the infant.

Another object of the invention is to provide an infant carrier of the type described and which establishes the appropriate support for either a newborn infant or a developing child.

Still another object of the invention is to provide an infant carrier which is selectively adjustable for positioning the infant at selected positions at the front of the person carrying the infant.

Yet another object of the invention is to provide an infant carrier which enables reversal from left to right of the position of the carried infant to reduce fatigue, enhance the comfort of both the infant and the person carrying the infant, and to facilitate breast feeding of the infant, as desired.

A further object of the invention is to provide an infant carrier having the appropriate contour configuration and weight distribution arrangement for optimum comfort of both the infant and the carrying person.

A still further object of the invention is to provide an infant carrier which is attractive yet simple in design, construction and use and is economical to manufacture in large quantities of high quality and reliability.

The above objects and advantages are attained by the present invention which may be described briefly as an infant carrier for supporting an infant in a selected position at the front of a person carrying the infant, the infant carrier comprising: a main member of flexible material, such as a textile, extending longitudinally between first and second ends and having first and second side edges spaced apart laterally; a main strap extending laterally from the first side edge of the main member and having a length for passing over a first shoulder and around the back of the person, the main strap terminating at longitudinally spaced apart locations along the first side edge; a first attachment means such as a first loop at the first end of the main member; a second attachment means such as a second loop located at the second side edge of the main member and spaced a first given distance from the first loop, the second loop being adapted to pass through the first loop; a third attachment means such as a third loop located at the first side edge of the main member and spaced a second given distance from the first loop; and a head strap extending longitudinally from the second end of the main member, the head strap having a length sufficient to be routed around the back of the person, over the shoulder opposite to the first shoulder, the first and second given distances, the length of the head strap, and the contour of each side edge between the first loop and the respective second and third loops being such that upon joining the head strap with the first, second and third loops, as by passage of the second loop through the first loop and routing of the head strap around the back of the person as aforesaid, thence through the third loop and the second loop, a first portion of the main member bounded by the first, second and third loops will establish a seat for the infant at the front of said person, while a second portion of the main member bounded by the second loop, the third loop and the head strap will establish a back and head support for the infant.

The invention will be understood more fully, while still further objects and advantages will become apparent, in the following detailed description of a preferred embodiment thereof illustrated in the accompanying drawing, in which.

Figure 1:
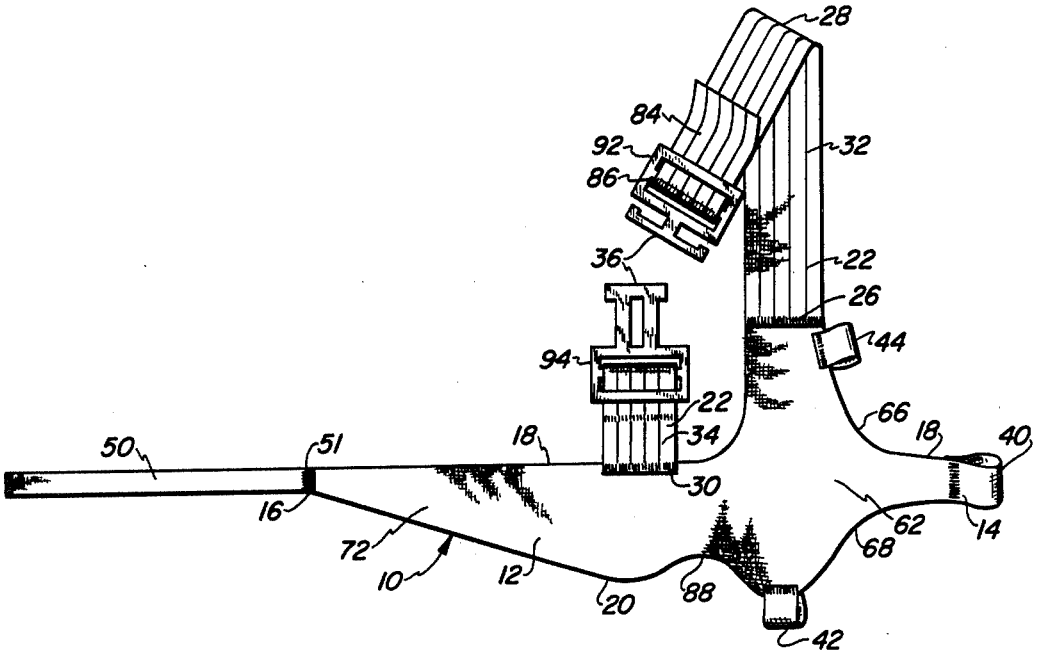
FIG. 1 is a partially pictorial plan view of an infant carrier constructed in accordance with the invention.

Referring now to the drawing, and especially to FIG. 1 thereof, an infant carrier constructed in accordance with the invention is shown at 10. Infant carrier 10 has a main member 12 fabricated of a flexible material, such as a textile or clothlike material. In the illustrated embodiment, main member 12 is constructed of a colorful woven cloth. Main member 12 extends longitudinally between a first end 14 and a second end 16 and has first and second side edges 18 and 20, respectively, spaced apart laterally.

A main strap 22, preferably constructed of a webbed belt material, is secured to the main member 12, as by a first sewn connection 26, and extends laterally from the first side edge 18. Main strap 22 is looped at 28 to return to the side edge 18 at a second sewn connection 30. In the preferred embodiment, main strap 22 is divided into segments 32 and 34 which are to be joined by a fastening means in the form of buckle 36, for purposes which will be explained in greater detail below; however, main strap 22 may be fabricated in a unitary structure extending between the first connection 26 at a first location along side edge 18 and the second connection 30 at a second location spaced longitudinally from the first location, along the side edge 18.

A first attachment means in the form of a first loop 40 is located at the first end 14 of the main member 12, a second attachment means in the form of a second loop 42 is located on the second side edge 20 and a third attachment means in the form of a third loop 44 is located on the first side edge 18. The second loop 42 is spaced a first given distance longitudinally from first loop 40, while the third loop 44 is spaced a second given distance longitudinally from the first loop 40. A head strap 50 extends longitudinally from the second end 16 and is affixed to main member 12 by means of a sewn connection 51.

Figure 2:
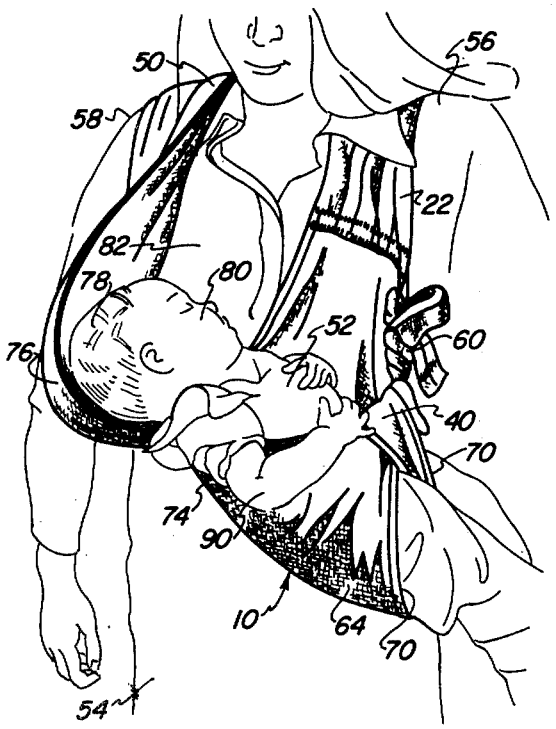
FIG. 2 is a pictorial view of the infant carrier showing an infant being carried in a reclining position at the front of a person.
Figure 3:
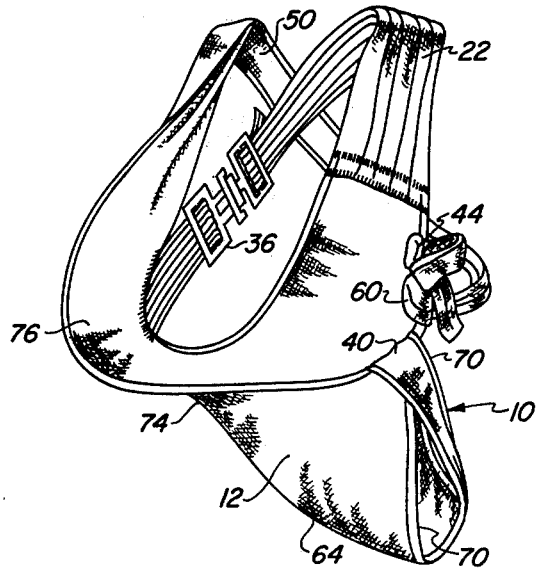
FIG. 3 is a perspective view of the infant carrier as it would be erected upon a person.
Figure 4:
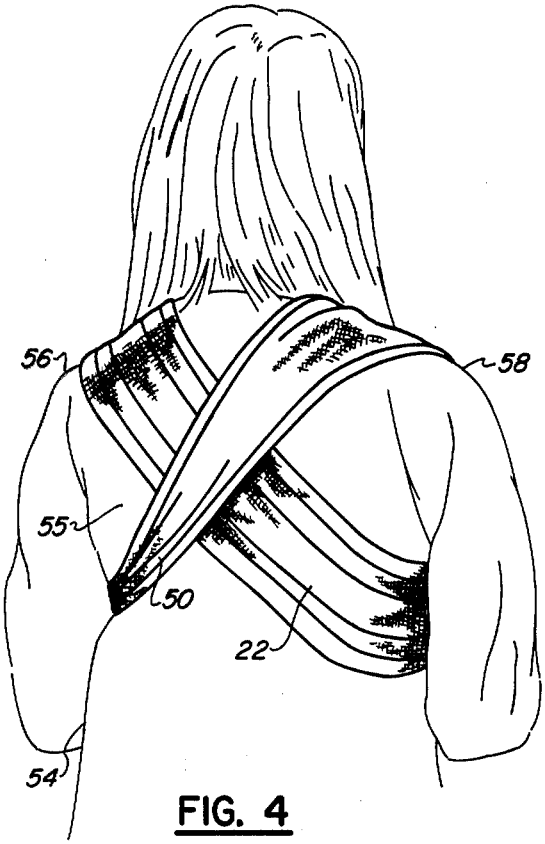
FIG. 4 is a pictorial view of the back of the person.

Turning now to FIGS. 2, 3 and 4, as well as to FIG. 1, infant carrier 10 is constructed to support an infant 52 at the front of a person 54, as illustrated in FIG. 2. Infant carrier 10 is placed upon person 54 by passing the main strap 22 over one shoulder 56 of the person 54 and diagonally across the back 55 of the person 54, as seen in FIGS. 2 and 4. The second loop 42, which preferably is smaller than first loop 40, is passed through first loop 40, and the head strap 50 is passed over the opposite shoulder 58 of person 54 and thence through third loop 44 and second loop 42. The head strap 50 is then fastened in place, as by tying a knot 60, to join the head strap to the loops 40, 42 and 44. In this manner, a first portion 62 of the main member 12 establishes a seat 64 for the infant 52, with the contour 66 along the first side edge 18 and the contour 68 along the second side edge 20 each providing the appropriate leg openings 70 in the erected seat 64.

As best seen in FIG. 1, first portion 62 is bounded by the first, second and third loops 40, 42 and 44, respectively. A second portion 72 of the main member 12 is bounded by second and third loops 42 and 44 and head strap 50 and establishes a back support 74, for supporting the infant 52 fully along its spinal column, and a head support 76 for holding the infant's head 78. As can be seen in FIG. 2, the infant 52 is supported in much the same way as it would be held in its mother's arms, with the infant 52 reclining diagonally across the front of the person 54, the infant's face 80 located adjacent the breast 82 of person 54 and the eyes and mouth of the infant fully in view. In addition, the infant is free to move its head to view either the person 54 or the world surrounding the infant. The weight of the infant is supported primarily by the seat 64, which is held firmly in place by the main strap 22.

Figure 5:
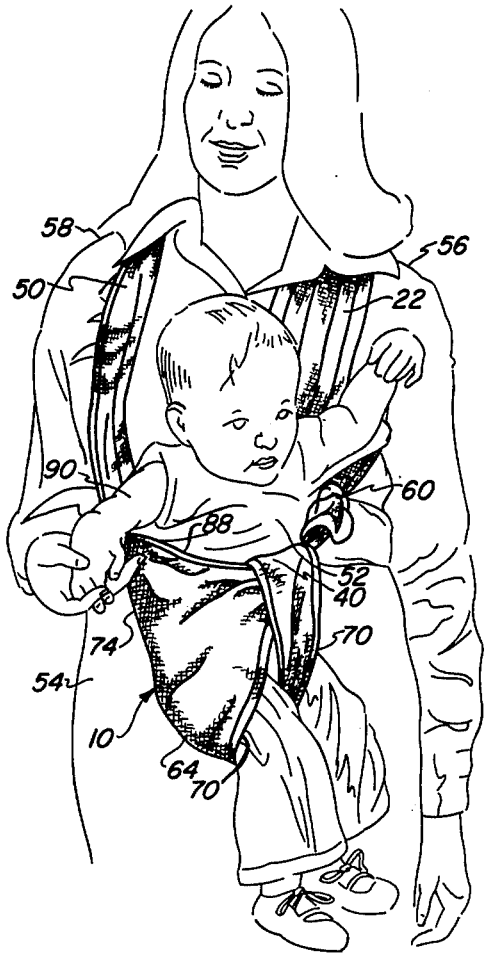
FIG. 5 is a pictorial view showing the infant carried in an alternate sitting position.

The breadth and routing of the main strap 22 assure comfort and safety. The location of the seat 64, upward or downward relative to the person 54, is adjusted by selecting the appropriate length of segment 32 adjacent end 84 where segment 32 engages buckle 36 and may be adjusted relative to buckle 36 at 86. The position of the infant 52 may be varied selectively by the placement of head strap 50 relative to the loops 42 and 44. Thus, where the head strap 50 is lengthened, the infant is placed in a reclined position, as seen in FIG. 2. Where the head strap 50 is shortened, by pulling more of the head strap 50 through loops 42 and 44, the seat 64 is tilted upwardly, as seen in FIG. 5, and the infant 52 is placed in a sitting position. The sitting position is available for the infant as the infant develops the requisite strength in its neck and back for sitting. In both the reclining position and the sitting position, the contour 88 along side edge 20 enables freedom of movement for the infant's arm 90.

Figure 6:
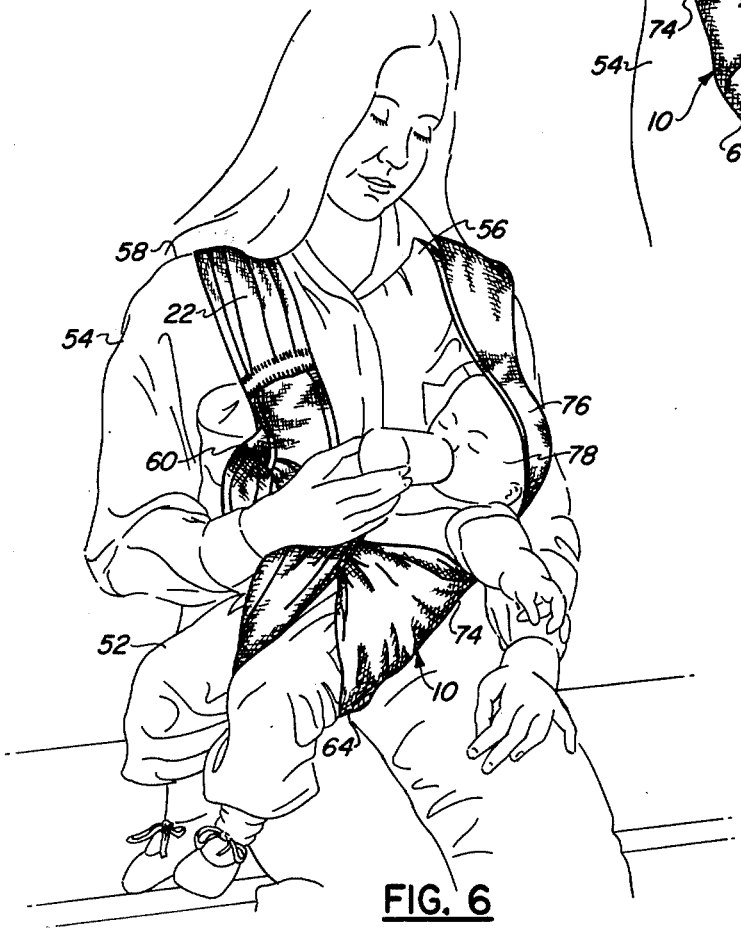
FIG. 6 is a pictorial view showing the infant carrier reversed from left to right on the person.

In FIG. 6, the infant carrier 10 has been reversed from left to right. Such reversal has been attained merely by passing main strap 22 over shoulder 58 of person 54, rather than over shoulder 56, and then routing head strap 50 over shoulder 56. All of the relationships among the loops 40, 42 and 44 and the head strap 50 remain the same as before. Buckle 36 is of the type which is reversible, that is, the two parts 92 and 94 of the buckle may be coupled in either of the two relative positions where part 92 is rotated 180° relative to part 94. In this manner, reversal of the entire infant support is accomplished without twisting the main strap 22.

The ability to reverse the infant carrier 10 reduces fatigue in carrying an infant and provides some variety for the infant. Additionally, the infant carrier 10 becomes universal since it can free either the right hand or the left hand of the person 54 for feeding the infant 52. Further, the infant's head 78 may be placed selectively adjacent the right breast or the left breast to facilitate breast feeding of a newborn infant.

When not in use, the infant carrier 10 may be folded into a compact package and stored with ease. Maintenance is simplified in that the entire unit may be washed or otherwise cleaned as necessary.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. An infant carrier for supporting an infant in a selected position at the front of a person carrying the infant, the infant carrier comprising:

a main member of flexible material, such as a textile, extending longitudinally between first and second ends and having first and second side edges of given contour spaced apart laterally;

a main strap extending laterally from a first location at the first side edge of the main member and having a length for passing over a first shoulder and around the back of said person, said main strap terminating at a second location longitudinally spaced from the first location along the first side edge;

a first loop at the first end of the main member;

a second loop located at the second side edge of the main member and spaced a first given distance from the first loop, said second loop being adapted to pass through the first loop;

a third loop located at the first side edge of the main member and spaced a second given distance from the first loop; and a head strap extending longitudinally from the second end of the main member, said head strap having a length sufficient to be routed around the back of said person, over the shoulder opposite to said first shoulder;

the first and second given distances, the length of the head strap, and the contour of each side edge between the first loop and the respective second and third loops being such that passage of the second loop through the first loop and routing of the head strap around the back of said person as aforesaid, thence through the third loop and the second loop, will enable a first portion of the main member bounded by the first, second and third loops to establish a seat for the infant at the front of said person, while a second portion of the main member bounded by the second loop, the third loop and the head strap will establish a back and head support for the infant.

2. The invention of claim 1 wherein the main strap is divided into segments joined by fastening means for enabling the length of the main strap to be selectively adjustable.

3. The invention of claim 2 wherein the fastening means is reversible so as to enable the main strap to pass over either shoulder of said person.

4. The invention of claim 1, 2 or 3 wherein the head strap may be secured to the second loop at selected locations along the length of the head strap to support the infant in any one of a variety of reclining and sitting positions.

5. The invention of claim 4 wherein the main member, the main strap, the head strap, and the first, second and third loops all are constructed of a cloth-like material and are joined together in an integral structure.

6. An infant carrier for supporting an infant in a selected position at the front of a person carrying the infant, the infant carrier comprising:

a main member of flexible material, such as a textile, extending longitudinally between first and second ends and having first and second side edges of given contour spaced apart laterally;

a main strap extending laterally from a first location of the first side edge of the main member and having a length for passing over a first shoulder and around the back of said person, said main strap terminating at a second location longitudinally spaced from the first location along the first side edge;

a first attachment means at the first end of the main member;

a second attachment means located at the second side edge of the main member and spaced a first given distance from the first attachment means;

a third attachment means located at the first side edge of the main member and spaced a second given distance from the first attachment means; and a head strap extending longitudinally from the second end of the main member, said head strap having a length sufficient to be routed around the back of said person, over the shoulder opposite to said first shoulder;

the first and second given distances, the length of the head strap, and the contour of each side edge between the first attachment means and the respective second and third attachment means being such that routing of the head strap around the back of said person as aforesaid, and then joining the head strap with the first, second and third attachment means, will enable a first portion of the main member bounded by the first, second and third attachment means to establish a seat for the infant at the front of said person, while a second portion of the main member bounded by the second attachment means, the third attachment means and the head strap will establish a back and head support for the infant.

7. The invention of claim 6 wherein the main strap includes means for selectively adjusting the length of the main strap.

8. The invention of claim 7 wherein the main strap is divided into segments joined by fastening means, and the fastening means is reversible so as to enable the main strap to pass over either shoulder of said person.

9. The invention of claim 8 wherein the main member, the main strap, the head strap, and the first, second and third attachment means all are constructed of a cloth-like material and are joined together in an integral structure.

* * * * *